US006806248B2

(12) United States Patent
Grainger et al.

(10) Patent No.: US 6,806,248 B2
(45) Date of Patent: Oct. 19, 2004

(54) FABRIC CONDITIONING COMPOSITIONS

(75) Inventors: David Stephen Grainger, Wirral (GB); Llyr Glyndwr Griffiths, Wirral (GB); Jane Howard, Wirral (GB); Mansur Sultan Mohammadi, Wirral (GB)

(73) Assignee: Unilever Home & Personal Care, USA, division of Conopco, Inc., Greenwich, CT (US)

( * ) Notice: Subject to any disclaimer, the term of this patent is extended or adjusted under 35 U.S.C. 154(b) by 103 days.

(21) Appl. No.: 10/237,485

(22) Filed: Sep. 9, 2002

(65) Prior Publication Data

US 2003/0114339 A1 Jun. 19, 2003

(30) Foreign Application Priority Data

Sep. 10, 2001 (GB) ..... 0121804

(51) Int. Cl.[7] ..... C11D 1/835
(52) U.S. Cl. ..... 510/527
(58) Field of Search ..... 510/504, 516, 510/522, 527

(56) References Cited

U.S. PATENT DOCUMENTS

| | | | | | |
|---|---|---|---|---|---|
| 5,066,414 | A | | 11/1991 | Chang | |
| 5,336,419 | A | | 8/1994 | Coffindaffer et al. | |
| 5,500,137 | A | | 3/1996 | Bacon et al. | |
| 5,916,863 | A | * | 6/1999 | Iacobucci et al. | 510/329 |
| 6,037,315 | A | * | 3/2000 | Franklin et al. | 510/123 |
| 6,303,565 | B1 | * | 10/2001 | Clarke et al. | 510/527 |
| 6,620,777 | B2 | * | 9/2003 | Heibel et al. | 510/516 |

FOREIGN PATENT DOCUMENTS

| | | | |
|---|---|---|---|
| EP | 0 459 821 | A | 12/1991 |
| EP | 0 544 493 | A1 | 6/1993 |
| EP | 730023 | * | 9/1996 |
| GB | 2 007 734 | A | 5/1979 |
| WO | 98/50502 | | 11/1998 |
| WO | 99/50378 | | 10/1999 |
| WO | 00/71806 | | 11/2000 |
| WO | 00/71807 | | 11/2000 |
| WO | 01/46361 | | 6/2001 |

OTHER PUBLICATIONS

International Search Report No. PCT/EP 02/10107, dated Dec. 16, 2002—3 pp.
Search Report under Section 17 (GB 0121804.9—dated Mar. 27, 2002).
"Quantitative $^{13}$C NMR Spectroscopy with Inverse Gated $^{1}$H–Decoupling"; *Quantitative Determinations*; pp. 234–236.
"On Interaction Between Two Bodies Immersed In A Solution Of Macromolecules"; S. Asakura and F. Oosawa; J. Chem. Phys.; 1954; pp. 1255–1256.
Related co–pending application: Grainger et al.; 10/237,481; filed Sep. 9, 2002; Fabric Conditioning Compositions.
Related co–pending application: Ilett; 10/237,480; filed Sep. 9, 2002; Fabric Conditioning Compositions.
Related co–pending application; Grainger et al.; 10/237,427; filed Sep. 9, 2002; A Method of Preparing Fabric Conditioning Compositions.
Related co–pending application; Eyers et al.; 10/237,398; filed Sep. 9, 2002; A Method of Reducing the Vicosity of Fabric Conditioning Compositions.
Related co–pending application; Grainger et al.; 10/237,484; filed Sep. 9, 2002; Fabric Conditioning Compositions.

* cited by examiner

*Primary Examiner*—John R. Hardee
(74) *Attorney, Agent, or Firm*—Ellen Plotkin

(57) ABSTRACT

A fabric conditioning composition comprises:

(a) from about 7.5 to 80% by weight of an ester-linked quaternary ammonium fabric softening material comprising comprising at least one mono-ester linked component and at least one tri-ester linked component;

(b) 0.9% to 15% by weight of a fatty complexing agent;

(c) an emulsified silicone wherein the weight ratio of the monoester linked component of compound (a) to compound (c) is from 5:1 to 1:5 and the emulsifier for the silicone comprises a nonionic compound.

9 Claims, No Drawings

FABRIC CONDITIONING COMPOSITIONS

FIELD OF THE INVENTION

The present invention relates to fabric conditioning compositions. More specifically, the invention relates to stable fabric-softening compositions comprising an ester-linked quaternary ammonium compound, an emulsified silicone and a long chain fatty compound.

BACKGROUND OF THE INVENTION

It is well known to provide liquid fabric conditioning compositions, which soften in the rinse cycle.

Such compositions comprise less than 7.5% by weight of softening active, in which case the composition is defined as "dilute", from 7.5% to about 30% by weight of active in which case the compositions are defined as "concentrated" or more than about 30% by weight of active, in which case the composition is defined as "super-concentrated".

Concentrated and super-concentrated compositions are desirable since these require less packaging and are therefore environmentally more compatible than dilute or semi-dilute compositions.

A problem frequently associated with concentrated and superconcentrated compositions, as defined above, is that the product is not stable upon storage, especially when stored at high temperatures. Instability can manifest itself as a thickening of the product upon storage, even to the point that the product is no longer pourable.

The problem of thickening upon storage is particularly apparent in concentrated and superconcentrated fabric softening compositions comprising an ester-linked quaternary ammonium fabric softening material having one or more fully saturated alkyl chains.

However, it is desirable to use ester-linked compounds due to their inherent biodegradability and to use substantially fully saturated quaternary ammonium fabric softening compounds due to their excellent softening capabilities and because they are more stable to oxidative degradation (which can lead to malodour generation) than partially saturated or fully unsaturated quaternary ammonium softening compounds.

Of the types of ester-linked quaternary ammonium materials known, it is desirable to use those based on triethanolamine which produce at least some mono-ester linked component and at least some tri-ester linked component since the raw material has a low melting temperature which enables the manufacturing process of the composition to occur at low temperatures. This reduces difficulties associated with high temperature handling, transport and processing of the raw material and compositions produced therefrom.

Frequently, it is desirable to add further ingredients into fabric conditioning compositions in order to provide additional benefits.

One such additional ingredient is an emulsified silicone. Emulsified silicones are desirable because they can provide fabric-conditioning compositions with anti-crease and ease of ironing benefits.

WO-A1-00/71806 discloses a fabric softening composition comprising a cationic fabric softening agent; and an emulsified silicone; wherein the viscosity of the silicone before emulsification is from 10,000 cSt to 1,000,000 cSt, preferably from 30,000 cSt to 750,000 cSt, more preferably from 40,000 cSt to 300,000 cSt and the emulsion is a macro-emulsion and the median droplet size of the emulsion particles is preferably from 0.39 $\mu$m to 25 $\mu$m.

WO-A1-00/71807 discloses a method of stabilising fabric softener compositions during high temperature storage. The examples show that by incorporating 3.5 to 15% by weight of a silicone emulsion into concentrated fabric conditioning compositions comprising 1,2-dihardened tallowoyloxyethyl, 3 tri-methyl ammoniopropane chloride (a quaternary ammonium material) high temperature storage stability is improved.

However, it has been found that a conditioning composition comprising a quaternary ammonium material based on triethanolamine, especially when the quaternary ammonium material contains saturated hydrocarbyl groups, can suffer from instability upon storage especially at high temperature when an emulsified silicone is present therein.

It is believed that this is due mainly to depletion flocculation.

"Depletion flocculation" was first recorded by Asakura and Oosawa in 1954 (J. Chem. Phys. 1954, 22, 1255) when they showed that the addition of a non-adsorbing polymer to a dispersion of colloidal particles led to an effective attractive interaction between them—flocculation.

Without wishing to be bound by theory, it is believed that quaternary ammonium materials based on triethanolamine are prone to depletion flocculation due to the presence of mono-ester linked quaternary ammonium species present in the continuous phase of the composition (i.e. mixed micelles). The introduction of an emulsified silicone exacerbates depletion flocculation by, firstly, liberating greater quantities of the mono-ester linked quaternary ammonium species into the continuous phase and, secondly, by the significant size difference between the particles present in the composition (i.e. between the smaller particles of the silicone emulsion and the larger liposomes of the quaternary ammonium material based on triethanolamine).

U.S. Pat. No. 5,336,419 discloses a nonionic emulsified silicone gel for ease of ironing and better looking garments. The softener dispersions range from 5.3 to 24wt % of a mixed softener system with 1 to 2.4wt % of a silicone emulsion.

WO 98/50502 discloses compositions comprising softening compounds based on triethanolamine and silicone emulsion mixtures.

OBJECTS OF THE INVENTION

The present invention seeks to address one or more of the above-mentioned problems, and, to give one or more of the above-mentioned benefits desired by consumers.

It has surprisingly been found that by incorporating a fatty component which comprises a long alkyl chain, such as fatty alcohols or fatty acids (hereinafter referred to as "fatty complexing agents") into softening compositions comprising a quaternary ammonium softening material having substantially fully saturated alkyl chains, at least some mono-ester component and at least some tri-ester component, and an emulsified silicone which comprises a nonionic emulsifier, wherein the fatty complexing agent is present in an amount significantly greater than normally present in traditional fabric softening compositions, then the stability and initial viscosity of the composition can be dramatically improved. In particular, undesirable thickening of the composition upon storage at high temperature can be avoided.

In the context of the present invention, "high temperature storage" denotes storage at 37° C. or above.

SUMMARY OF THE INVENTION

According to the present invention there is provided a fabric conditioning composition comprising:

(a) from about 7.5 to 80% by weight of an ester-linked quaternary ammonium fabric softening material comprising comprising at least one mono-ester linked component and at least one tri-ester linked component;

(b) 0.9% to 15% by weight of a fatty complexing agent;

(c) an emulsified silicone wherein the weight ratio of the mono-ester linked component of compound (a) to compound (c) is from 5:1 to 1:5 and the emulsifier for the silicone comprises a nonionic emulsifier.

There is also provided a method for treatment of fabrics comprising contacting the above-mentioned composition with fabrics in a laundry treatment process.

In the context of the present invention, the term "comprising" means "including" or "consisting of". That is the steps, components, ingredients, or features to which the term "comprising" refers are not exhaustive.

For the avoidance of doubt, the term "emulsified silicone" means that the silicone is emulsified prior to incorporation into the fabric conditioning composition but does not necessarily remain emulsified once incorporated therein.

DETAILED DESCRIPTION OF THE INVENTION

The compositions of the present invention are preferably rinse conditioner compositions, more preferably aqueous rinse conditioner compositions for use in the rinse cycle of a domestic laundry process.

Quaternary Ammonium Fabric Softening Material

The fabric conditioning material used in the compositions of the present invention comprises one or more quaternary ammonium materials comprising a mixture of monoester linked, di-ester linked and tri-ester linked compounds.

By mono-, di- and tri-ester linked components, it is meant that the quaternary ammonium softening material comprises, respectively, a quaternary ammonium compound comprising a single ester-link with a fatty hydrocarbyl chain attached thereto, a quaternary ammonium compound comprising two ester-links each of which has a fatty hydrocarbyl chain attached thereto, and a quaternary ammonium compound comprising three ester-links each of which has a fatty hydrocarbyl chain attached thereto.

Below is shown typical levels of mono-, di- and tri-ester linked components in a fabric softening material used in the compositions of the invention.

| Component | % by weight of the raw material (TEA based softener with solvent) |
|---|---|
| Mono-ester | 10–30 |
| Di-ester | 30–60 |
| Tri-ester | 10–30 |
| Free fatty acid | 0.2–1.0 |
| Solvent | 10–20 |

The level of the mono-ester linked component of the quaternary ammonium material used in the compositions of the invention is preferably between 8 and 40% by weight, based on the total weight of the raw material in which the quaternary ammonium material is supplied.

The level of the tri-ester-linked component is preferably between 20 and 50% based on the total weight of the raw material in which the quaternary ammonium material is supplied.

Preferably, the average chain length of the alkyl or alkenyl group is at least $C_{14}$, more preferably at least $C_{16}$. Most preferably at least half of the chains have a length of $C_{18}$.

It is generally preferred if the alkyl or alkenyl chains are predominantly linear.

The preferred ester-linked quaternary ammonium cationic softening material for use in the invention is represented by formula (I):

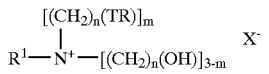

(Formula I)

wherein each R is independently selected from a $C_{5-35}$ alkyl or alkenyl group, $R^1$ represents a $C_{1-4}$ alkyl or hydroxyalkyl group or a $C_{2-4}$ alkenyl group, T is

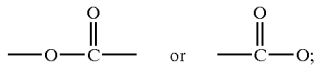

n is O or an integer selected from 1 to 4, m is 1, 2 or 3 and denotes the number of moieties to which it refers that pend directly from the N atom, and $X^-$ is an anionic group, such as halides or alkyl sulphates, e.g. chloride, methyl sulphate or ethyl sulphate.

Especially preferred materials within this class are di-alkyl and di-alkenyl esters of triethanol ammonium methyl sulphate. Commercial examples of compounds within this formula are Tetranyl® AHT-1 (di-hardened tallowyl ester of triethanol ammonium methyl sulphate 85% active), L1/90 (partially hardened tallow ester of triethanol ammonium methyl sulphate 90% active), and L5/90 (palm ester of triethanol ammonium methyl sulphate 90% active), all ex Kao corporation), Rewoquat WE18 and WE20 (both are partially hardened tallow ester of triethanol ammonium methyl sulphate 90% active), both ex Goldschmidt Corporation and Stepantex VK-90 (partially hardened tallow ester of triethanol ammonium methyl sulphate 90% active), ex Stepan Company).

Iodine Value of the Parent Fatty Acyl Group or Acid

The iodine value of the parent fatty acyl compound or acid from which the quaternary ammonium fabric softening material is formed is from 0 to 20, preferably from 0 to 5, more preferably from 0 to 2. Most preferably the iodine value of the parent fatty acid or acyl group from which the quaternary ammonium fabric softening material is formed is from 0 to 1. That is, it is preferred that the alkyl or alkenyl chains are substantially fully saturated.

If there is any unsaturated quaternary ammonium fabric softening material present in the composition, the iodine value, referred to above, represents the mean iodine value of the parent fatty acyl compounds or fatty acids of the unsaturated material together and the (substantially) saturated fabric softening material.

In the context of the present invention, iodine value of the parent fatty acyl compound or acid from which the fabric softening material formed, is defined as the number of grams of iodine which react with 100 grams of the compound.

In the context of the present invention, the method for calculating the iodine value of a parent fatty acyl compound/acid comprises dissolving a prescribed amount (from 0.1–3 g) into about 15 ml chloroform. The dissolved parent fatty acyl compound/fatty acid is then reacted with 25 ml of iodine monochloride in acetic acid solution (0.1M). To this, 20 ml of 10% potassium iodide solution and about 150-ml deionised water is added. After addition of the halogen has taken place, the excess of iodine monochloride is determined by titration with sodium thiosulphate solution (0.1M) in the presence of a blue starch indicator powder. At the same time a blank is determined with the same quantity of reagents and under the same conditions. The difference between the volume of sodium thiosulphate used in the blank and that used in the reaction with the parent fatty acyl compound or fatty acid enables the iodine value to be calculated.

The quaternary ammonium fabric softening material of formula (I) is present in an amount from about 7.5 to 80% by weight of quaternary ammonium material (active ingredient) based on the total weight of the composition, more preferably 10 to 60% by weight, most preferably 11 to 40% by weight, e.g. 12.5–25% by weight.

Excluded Quaternary Ammonium Compounds

Quaternary ammonium fabric softening materials which are free of ester linkages or, if ester-linked, do not comprise at least some monoester linked component and some tri-ester linked component are excluded from the scope of the present invention. For instance, quaternary ammonium compounds having the following formulae are excluded:

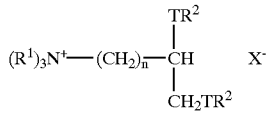

wherein $R^1$, $R^2$, T, n and $X^-$ are as defined above; and

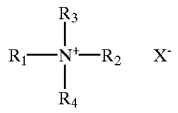

where $R_1$ to $R_4$ are not interrupted by ester-links, $R_1$ and $R_2$ are $C_{8-28}$ alkyl or alkenyl groups; $R_3$ and $R_4$ are $C_{1-4}$ alkyl or $C_{2-4}$ alkenyl groups and $X^-$ is as defined above.

Fatty Complexing Agent

The compositions of the present invention comprise a fatty complexing agent.

Suitable fatty complexing agents include fatty alcohols and fatty acids. Of these, fatty alcohols are most preferred. Without wishing to be bound by theory, it is believed that the monoester quaternary ammonium species of the quaternary ammonium material complexes with the fatty complexing material.

It is also believed that the higher monoester levels present in compositions comprising quaternary ammonium materials based on TEA may destabilise the composition through depletion flocculation. By using the fatty complexing material to complex with the monoester component, depletion flocculation is significantly reduced.

In other words, the fatty component at the increased levels, as required by the present invention, "neutralises" the monoester component of the quaternary ammonium material.

The applicants also believe that that the complexing of the monoester linked component (which does not contribute to softening) with the fatty complexing material thereby provides a material, which does contribute to softening.

The applicants further believe that the presence of the fatty complexing agent in the compositions of the invention reduces the size of the liposomes (of the quaternary ammonium material) present. The size disparity between the liposomes and the emulsified silicone particles is therefore smaller and, therefore, depletion flocculation is reduced.

Preferred fatty acids include hardened tallow fatty acid (available under the tradename Pristerene, ex Uniqema).

Preferred fatty alcohols include hardened tallow alcohol (available under the tradenames Stenol and Hydrenol, ex Cognis and Laurex CS, ex Albright and Wilson) and behenyl alcohol, a C22 chain alcohol, available as Lanette 22 (ex Henkel).

The fatty complexing agent is present in an amount within the range 0.9% to 15% by weight based on the total weight of the composition. More preferably, the fatty component is present in an amount of from 1.2 to 10%, most preferably from 1.5 to 5%, e.g. 1.6 to 4% by weight.

The weight ratio of the mono-ester component of the quaternary ammonium fabric softening material to the fatty complexing agent is preferably from 5:1 to 1:5, more preferably 4:1 to 1:4, most preferably 3:1 to 1:3, e.g. 2:1 to 1:2.

Calculation of Mono-ester Linked Component of the Quaternary Anmonium Material

The quantitative analysis of mono-ester linked component of the quaternary ammonium material is carried out through the use of Quantitative $^{13}C$ NMR spectroscopy with inverse gated $^1H$ decoupling scheme.

The sample of known mass of the quaternary ammonium raw material is first dissolved in a known volume of $CDCl_3$ along with a known amount of an assay material such as naphthalene. A $^{13}C$ NMR spectrum of this solution is then recorded using both an inverse gated decoupling scheme and a relaxation agent. The inverse gated decoupling scheme is used to ensure that any Overhauser effects are suppressed whilst the relaxation agent is used to ensure that the negative consequences of the long $t_1$ relaxation times are overcome (i.e. adequate signal-to-noise can be achieved in a reasonable timescale).

The signal intensities of characteristic peaks of both the carbon atoms in the quaternary ammonium material and the naphthalene are used to calculate the concentration of the monoester-linked component of the quaternary ammonium material. In the quaternary ammonium material, the signal represents the carbon of the nitrogen-methyl group on the quaternary ammonium head group. The chemical shift of the nitrogen-methyl group varies slightly due to the different degree of esterification; characteristic chemical shifts for the mono-, di- and tri-ester links are 48.28, 47.97 and 47.76 ppm respectively. Any of the peaks due to the napthalene carbons that are free of interference from other components can then be used to calculate the mass of mono-ester linked component present in the sample as follows:

$$\text{Mass}_{MQ}(\text{mg/ml})=(\text{mass}_{Naph}\times I_{MQ}\times N_{Naph}\times M_{MQ})/(I_{Naph}\times N_{MQ}\times M_{Naph})$$

where $\text{Mass}_{MQ}$=mass mono-ester linked quaternary ammonium material in mg/ml, $\text{mass}_{Naph}$=mass naphthalene in mg/ml, I=peak intensity, N=number of contributing nuclei and M=relative molecular mass. The relative molecular mass of naphthalene used is 128.17 and the relative molecular mass of the mono-ester-linked component of the quaternary ammonium material is taken as 526.

The weight percentage of mono-ester linked quaternary ammonium material in the raw material can thus be calculated:

$$\%\text{ of mono-ester linked quaternary ammonium material in the raw material}=(\text{mass}_{MQ}/\text{mass}_{HT\text{-}TEA})\times 100$$

where $\text{mass}_{HT\text{-}TEA}$=mass of the quaternary ammonium material and both $\text{mass}_{MQ}$ and $\text{mass}_{HT\text{-}TEA}$ are expressed as mg/ml.

For a discussion of the NMR technique, see "100 and More Basic NMR Experiments", S Braun, H-O Kalinowski, S Berger, 1st edition, pages 234–236.

Emulsified Silicone

In the emulsified silicone, the silicone droplets are preferably incorporated to be in the form of a macro-emulsion, that is to say the droplets have a median size in the wavelength range corresponding to the visible spectrum, or even larger. Preferably, the emulsion is an oil-in-water emulsion. The term "median size" refers to the number average. The visible spectrum is 0.39 μm to 0.77 μm. In the emulsion, the silicone droplets are then preferably from 0.2 μm to 25 μm, more preferably from 0.25 μm to 20 μm, most preferably from 0.39 μm to 15 μm. The droplet size may be determined based on measurements of median DV05 using a Malvern X Mastersizer.

The silicone may be of any structure, which gives rise to one or more of the desired benefits in use of the fabric softener formulation. Preferably, it has a linear structure. It is preferably a non-functional silicone, especially one which is non-amino functional. Typical silicones are siloxanes which have the general formula $R_aSiO_{(4-a)/2}$ wherein each R is the same or different and is selected from hydrocarbon and hydroxyl groups, 'a' being from 0 to 3 and in the bulk material; 'a' has an average value of from 1.85–2.2.

Most preferably, the silicone is a polydi-$C_{1-6}$alkyl (preferably a polydimethyl) siloxane end-terminated either by tri-$C_{1-6}$ alkylsilyl (e.g. trimethylsilyl) or hydroxy-di-$C_{1-6}$ alkylsilyl (e.g. hydroxy-dimethylsilyl) groups, or by both.

Preferably, the silicone has a viscosity before emulsification (as measured on a Brookfield RV4 viscometer at 25° C. using spindle No.4 at 100 rpm) of from 10,000 cSt to 1,000,000 cSt, preferably from 30,000 cSt to 750,000 cSt, more preferably from 40,000 cSt to 400,000 cSt, most preferably 45,000 cSt to 250,000 cSt, e.g. 45,000 cSt to 200,000 cSt.

Emulsification is effected using one or more nonionic surfactants.

Nonionic emulsifiers suitable for use in the compositions of the present invention are defined below.

Although silicones emulsified with a cationic emulsifier can, when in the presence of a quaternary ammonium material having at least one mono-ester linked component and at least one tri-ester linked component, deliver anti-crease and ease of ironing benefits, they are found to be less stable than such compositions comprising nonionically emulsified silicones. Therefore, for the purposes of the present invention, the emulsifier must not be a cationic emulsifier.

Preferably, the total of amount of emulsifying surfactant (s) is from 0.5% to 20%, preferably from 2% to 12%, more preferably from 3% to 10% by weight of the emulsion.

The emulsified silicone (as 100% active silicone) may be included in the fabric softener compositions in an amount of 3.5% to 15% by weight of the total composition (including the emulsion product containing the silicone emulsion), preferably 3.75% to 12%, more preferably 4% to 10%, most preferably 4.5% to 10%. However, it may be possible to include up to 20% by weight if it can be incorporated into the fabric softening composition without instability occurring therein. The total amount of silicone in the emulsion will generally be up to 70% by weight of the emulsion.

Preferably, the weight ratio of silicone to total emulsifying surfactant(s) is from 2.3:1 to 120:1, more preferably 3:1 to 120:1, for example from 3:1 to 30:1. In the final product, the weight ratio of total fabric softening agent to total silicone is from 1:1 to 70:1, more preferably from 1.5:1 to 25:1, more preferably 2.5:1 to 10:1, e.g. 3:1 to 7:1.

Nonionic Emulsifier for the Silicone

The compositions of the invention comprise a nonionic emulsifier for the silicone.

Suitable nonionic emulsifiers include the addition products of ethylene oxide and/or propylene oxide with fatty alcohols, fatty acids and fatty amines.

Any of the alkoxylated materials of the particular type described hereinafter can be used as the nonionic emulsifier.

Suitable emulsifiers are substantially water-soluble surfactants of the general formula:

$$R—Y—(C_2H_4O)_z—C_2H_4OH$$

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms.

In the general formula for the ethoxylated nonionic surfactant, Y is typically:

$$—O—,\ —C(O)O—,\ —C(O)N(R)— \text{ or } —C(O)N(R)R—$$

in which R has the meaning given above or can be hydrogen; and Z is at least about 8, preferably at least about 10 or 11.

Preferably the nonionic emulsifier has an HLB of from about 7 to about 20, more preferably from 10 to 18, e.g. 12 to 16.

It is particularly desirable that a mixture of nonionic emulsifiers is used to emulsify the silicone. For instance, a mixture of at least one low HLB (e.g. less than 12) and at least one high HLB (e.g. 12 or more) emulsifier is especially preferred.

Examples of nonionic emulsifiers follow. In the examples, the integer defines the number of ethoxy (EO) groups in the molecule.

A. Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful emulsifiers in the context of this invention. Exemplary ethoxylated primary alcohols useful herein as the emulsifiers of the compositions are $C_{18}$ EO(10); and $C_{18}$ EO(11). The ethoxylates of mixed natural or synthetic alcohols in the "tallow" chain length range are also useful herein. Specific examples of such materials include tallow alcohol-EO(11), tallow alcohol-EO(18), and tallow alcohol-EO(25), coco alcohol-EO(10), coco alcohol-EO(15), coco alcohol-EO(20) and coco alcohol-EO(25).

B. Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful emulsifiers in the context of this invention. Exemplary ethoxylated secondary alcohols useful herein as the viscosity and/or dispersibility modifiers of the compositions are: $C_{16}$ EO(11); $C_{20}$ EO(11); and $C_{16}$ EO(14).

C. Alkyl Phenol Alkoxylates

As in the case of the alcohol alkoxylates, the hexa- to octadeca-ethoxylates of alkylated phenols, particularly monohydric alkylphenols, having an HLB within the range recited herein are useful as the emulsifiers of the instant compositions. The hexa- to octadeca-ethoxylates of p-tridecylphenol, m-pentadecylphenol, and the like, are useful herein. Exemplary ethoxylated alkylphenols useful as the emulsifiers of the mixtures herein are: p-tridecylphenol EO(11) and p-pentadecylphenol EO(18).

As used herein and as generally recognised in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

D. Olefinic Alkoxylates

The alkenyl alcohols, both primary and secondary, and alkenyl phenols corresponding to those disclosed immediately hereinabove can be ethoxylated to an HLB within the range recited herein and used as the emulsifiers of the instant compositions.

E. Branched Chain Alkoxylates

Branched chain primary and secondary alcohols, which are available from the well-known "OXO" process, can be ethoxylated and employed as the emulsifiers of compositions herein.

F. Polyol Based Surfactants

Suitable polyol based surfactants useful as the emulsifiers of the instant compositions include sucrose esters such sucrose monooleates, alkyl polyglucosides such as stearyl monoglucosides and stearyl triglucoside and alkyl polyglycerols.

The above nonionic surfactants are useful as emulsifiers in the present compositions alone or in combination, and the term "nonionic emulsifier" encompasses mixed nonionic emulsifier systems.

Perfume

The compositions of the invention preferably comprise one or more perfumes.

The hydrophobicity of the perfume and oily perfume carrier are measured by ClogP. ClogP is calculated using the "ClogP" program (calculation of hydrophobicities as logP (oil/water)) version 4.01, available from Daylight Chemical Information Systems Inc of Irvine Calif., USA.

It is well known that perfume is provided as a mixture of various components.

It is preferred that at least a quarter (by weight) or more, preferably a half or more of the perfume components have a ClogP of 2.0 or more, more preferably 3.0 or more, most preferably 4.5 or more, e.g. 10 or more.

Suitable perfumes having a ClogP of 3 or more are disclosed in U.S. Pat. No. 5,500,137.

The perfume is preferably present in an amount from 0.01 to 10% by weight, more preferably 0.05 to 5% by weight, most preferably 0.5 to 4.0% by weight, based on the total weight of the composition.

Liquid Carrier

The liquid carrier employed in the instant compositions is preferably water due to its low cost relative availability, safety, and environmental compatibility. The level of water in the liquid carrier is more than about 50%, preferably more than about 80%, more preferably more than about 85%, by weight of the carrier. The level of liquid carrier is greater than about 50%, preferably greater than about 65%, more preferably greater than about 70%. Mixtures of water and a low molecular weight, e.g. <100, organic solvent, e.g. a lower alcohol such as ethanol, propanol, isopropanol or butanol are useful as the carrier liquid. Low molecular weight alcohols including monohydric, dihydric (glycol, etc.) trihydric (glycerol, etc.), and polyhydric (polyols) alcohols are also suitable carriers for use in the compositions of the present invention.

Co-active Softening Agent

Co-active softeners for the cationic surfactant may also be incorporated in an amount from 0.01 to 20% by weight, more preferably 0.05 to 10%, based on the total weight of the composition. Preferred co-active softeners include fatty esters, and fatty N-oxides.

Preferred fatty esters include fatty monoesters, such as glycerol monostearate. If GMS is present, then it is preferred that the level of GMS in the composition, is from 0.01 to 10 wt %, based on the total weight of the composition.

The co-active softener may also comprise an oily sugar derivative. Suitable oily sugar derivatives, their methods of manufacture and their preferred amounts are described in WO-A1-01/46361 on page 5 line 16 to page 11 line 20, the disclosure of which is incorporated herein.

Viscosity Control Agents

It is useful, though not essential, if the compositions comprise one or more viscosity control agents, such as polymeric viscosity control agents. Suitable polymeric polymeric viscosity control agents include nonionic and cationic polymers, such as hydrophobically modified cellulose ethers (e.g. Natrosol Plus, ex Hercules), cationically modified starches (e.g. Softgel BDA and Softgel BD, both ex Avebe). A particularly preferred viscosity control agent is a copolymer of methacrylate and cationic acrylamide available under the tradename Flosoft 200 (ex SNF Floerger).

Nonionic and/or cationic polymers are preferably present in an amount of 0.01 to 5 wt %, more preferably 0.02 to 4 wt %, based on the total weight of the composition.

It is preferred that the compositions are substantially free of bleaches.

Further Optional Ingredients

The compositions may also contain one or more optional ingredients conventionally included in fabric conditioning compositions such as pH buffering agents, perfume carriers, fluorescers, colourants, hydrotropes, antifoaming agents, antiredeposition agents, polyelectrolytes, enzymes, optical brightening agents, anti-shrinking agents, anti-wrinkle agents, anti-spotting agents, antioxidants, sunscreens, anti-corrosion agents, drape imparting agents, bactericides, soil-releases agents and dyes.

Product Form

In its undiluted state at ambient temperature the product comprises an aqueous liquid. Preferably the liquid is an emulsion. It is especially preferred that the composition is a macro-emulsion and not a microemulsion.

Product Use

The composition is preferably used in the rinse cycle of a home textile laundering operation, where, it may be added directly in an undiluted state to a washing machine, e.g. through a dispenser drawer or, for a top-loading washing machine, directly into the drum. Alternatively, it can be diluted prior to use. The compositions may also be used in a domestic hand-washing laundry operation.

It is also possible, though less desirable, for the compositions of the present invention to be used in industrial laundry operations, e.g. as a finishing agent for softening new clothes prior to sale to consumers.

Preparation

A first preferred method for preparing a fabric conditioning composition comprising a silicone emulsion involves post-dosing the silicone emulsion into a mixture of the water and the co-melted quaternary ammonium material, fatty complexing agent and, optionally, nonionic surfactant.

Alternatively the silicone emulsion can be incorporated into the heated batch water prior to addition of the co-melted quaternary ammonium material, fatty complexing agent and optional nonionic surfactant, in which case, less heated batch water is required in the composition because heated batch water is present as part of the silicone emulsion.

EXAMPLES

The invention will now be illustrated by the following non-limiting examples. Further modifications will be apparent to the person skilled in the art.

Samples of the invention are represented by a number. Comparative samples are represented by a letter.

All values are % by weight of the active ingredient unless stated otherwise.

Example 1

The following compositions comprising cationically emulsified silicone were prepared as follows:

Water was heated to 70° C. The quaternary ammonium material, fatty complexing agent and nonionic surfactant were co-melted and added to the water. The mixture was then allowed to cool to 50° C. (samples A to C) or 30° C. (samples D and E). Perfume was then added (samples A to C and E) and the mixture milled using a Janke arid Kunkel mill on high setting. For sample D the perfume was added after milling.

The silicone emulsion was then added and the mixture was further milled, as required.

TABLE 1

| | A | B | C | D | E |
|---|---|---|---|---|---|
| Quaternary ammonium material (1) | 12.50 | 11.40 | 11.40 | 11.11 | 13.00 |
| Fatty complexing agent (2) | 0.50 | 1.60 | 1.60 | 1.89 | 1.89 |
| Nonionic surfactant (3) | 0.75 | 0.75 | 0.75 | 0.75 | 0.60 |
| Silicone emulsion (4) | 5.00 | 5.00 | 5.00 | 5.00 | 5.00 |
| Preservative (5) | 0.04 | 0.04 | 0.04 | 0.04 | 0.04 |
| Dye | 0.0049 | 0.0049 | 0.0049 | 0.0049 | 0.0049 |
| Perfume (6) | 0.95 | 0.95 | 0.95 | 0.95 | 0.95 |
| Water | To 100 | To 100 | To 100 | To 100 | To 100 |

(1) Tetranyl AHT1 ex Kao (provided as 85% active, 15% IPA).
(2) Laurex CS (ex Albright and Wilson). A hardened tallow alcohol.
(3) Genapol C200 (ex Clariant). A C9–11 alcohol with 20 ethoxy moieties per molecule.
(4) FM58 ex Dow Corning. A cationically emulsified polydimethylsiloxane provided as 60% silicone emulsion.
(5) Proxel. Provided as a 20% solution.
(6) Euroglide 5

The viscosity readings upon storage at various temperatures were measured. The results are given in table 2, below.

TABLE 2

| | | A | B | C | D | E |
|---|---|---|---|---|---|---|
| Initial viscosity | 20 $s^{-1}$ | 122 | 62 | 121 | 65 | 59 |
| | 106 $s^{-1}$ | 48 | 28 | 47 | 34 | 28 |
| 4 weeks at 4° C. | 20 $s^{-1}$ | 364 | 80 | 77 | 90 | 80 |
| | 106 $s^{-1}$ | 141 | 29 | 31 | 34 | 35 |
| 4 weeks at 25° C. | 20 $s^{-1}$ | 608 | 77 | 81 | 83 | 90 |
| | 106 $s^{-1}$ | 150 | 31 | 35 | 35 | 39 |
| 4 weeks at 37° C. | 20 $s^{-1}$ | 912 | 834 | 1010 | 700 | 560 |
| | 106 $s^{-1}$ | 238 | 231 | 275 | 240 | 240 |

Viscosity was measured using a Haake Rotoviscometer RV20 NV cup and bob.

The results demonstrate that the compositions comprising a cationically emulsified silicone suffer from high temperature thickening of the composition both when low and high levels of fatty complexing agent are present.

Example 2

The following conditioning compositions comprising a nonionically emulsified silicone were prepared as follows:

In samples F, H and 1, water was heated to 70° C., the quaternary ammonium material, fatty complexing agent and nonionic surfactant were co-melted and added to the water. The mixture was then allowed to cool to between 30° C. and 50° C. and perfume added. Finally the silicone was added to the mixture with milling using a Janke and Kunkel mill on high setting, as required.

In samples G and 2, the water was heated to 70° C., and the silicone emulsion was added to the water. The quaternary ammonium material, fatty complexing agent and nonionic surfactant were co-melted and added to the water/silicone emulsion mixture. The mixture was then allowed to cool to between 30° C. and 50° C. and perfume added. Finally the mixture was milled using a Janke and Kunkel mill on high setting, as required.

TABLE 3

| | F | G | H | 1 | 2 |
|---|---|---|---|---|---|
| Quaternary ammonium material (1) | 12.50 | 12.50 | 13.00 | 11.11 | 11.47 |
| Fatty complexing agent (2) | 0.50 | 0.50 | 0.60 | 1.60 | 1.60 |
| Nonionic surfactant (3) | 0.75 | 0.75 | 0.60 | 0.75 | 0.75 |
| Silicone emulsion (4) | 4.17 | 4.17 | 4.17 | 4.17 | 4.17 |
| preservative (5) | 0.04 | 0.04 | 0.04 | 0.04 | 0.04 |
| Dye | 0.008 | 0.004 | 0.004 | 0.004 | 0.004 |
| Perfume (6) | 0.95 | 0.95 | 0.95 | 0.95 | 0.95 |
| Water | To 100 | To 100 | To 100 | To 100 | To 100 |

(1) Tetranyl AHT1 ex Kao (provided as 85% active, 15% IPA).
(2) Laurex CS (ex Albright and Wilson). A hardened tallow alcohol.
(3) Genapol C200 (ex Clariant). A C9–11 alcohol with 20 ethoxy moieties per molecule.
(4) HV600 (ex Dow Corning). A nonionically emulsified polydimethylsiloxane provided as 50% silicone emulsion comprising 50 wt % polydimethylsiloxane (methyl terminated), 2.9 wt % C12 alcohol with 4 ethoxy moieties per molecule, 2.1 wt % C12 alcohol with 23 ethoxy moieties per molecule and the balance of water. The median emulsion particle size is 0.5 $\mu$m.
(5) Proxel. Provided as a 20% solution.
(6) Euroglide 5

The viscosity was measured at various temperatures over a period of time. The results are given in table 4, below.

TABLE 4

Viscosity results

| | | F | G | H | 1 | 2 |
|---|---|---|---|---|---|---|
| Initial viscosity | 20 $s^{-1}$ | 122 | 121 | 129 | 100 | 115 |
| | 106 $s^{-1}$ | 52 | 56 | 57 | 44 | 50 |
| 4 weeks at 4° C. | 20 $s^{-1}$ | 62 | 74 | 110 | 81 | 117 |
| | 106 $s^{-1}$ | 28 | 37 | 56 | 32 | 46 |
| 4 weeks at 25° C. | 20 $s^{-1}$ | 156 | 230 | 276 | 82 | 131 |
| | 106 $s^{-1}$ | 85 | 110 | 120 | 37 | 57 |
| 4 weeks at 37° C. | 20 $s^{-1}$ | 627 | 797 | 635 | 142 | 182 |
| | 106 $s^{-1}$ | 196 | 229 | 199 | 74 | 81 |

Viscosity was measured using a Haake Rotoviscometer RV20 NV cup and bob.

The results demonstrate, when the silicone emulsion is nonionically emulsified, the compositions are unstable on high temperature storage when insufficient fatty complexing agent is present and that stability upon storage at high temperature is only achieved when both the silicone is emulsified with a nonionic emulsifier and a fatty complexing agent is present in the composition at a high level.

What is claimed is:

1. A fabric conditioning composition comprising:

(a) about 7.5% to 80% by weight of an ester-linked quaternary ammonium fabric softening material comprising at least one mono-ester linked component and at least one tri-ester linked component;

(b) 0.9% to 15% by weight of a fatty complexing agent;

(c) an emulsified silicon; and (d) an oily sugar derivative;

wherein the weight ratio of the mono-ester linked component of compound (a) to compound (c) is from 5:1 to 1:5 and the emulsifier for the silicone comprises a nonionic emulsifier.

2. A method for treatment of fabrics comprising contacting the composition as claimed in claim 1 with fabrics in a laundry treatment process.

3. A composition as claimed in claim 1, wherein the weight ratio of the mono-ester component of compound (a) to fatty complexing agent (c) is about 3:1 to about 1:3.

4. A composition as claimed in claim 1, wherein the fatty complexing agent comprises a fatty alcohol.

5. A composition as claimed in claim 1, wherein the fatty alcohol is tallow alcohol.

6. A composition as claimed in claim 1, wherein the nonionic emulsifier comprises an ethoxylated nonionic surfactant.

7. The composition as claimed in claim 1, wherein the quaternary ammonium material is represented by formula (I):

(Formula I)

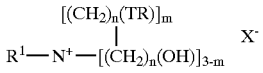

wherein each R is independently selected from a $C_{5-35}$ alkyl or alkenyl group, $R^1$ represents a $C_{1-4}$ alkyl or hydroxyalkyl group or a $C_{2-4}$ alkenyl group, T is 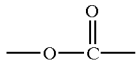 or 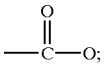 ;

n is O or an integer selected from 1 to 4, m is 1, 2 or 3 and denotes the number of moieties to which it refers that pend directly from the N atom, and $X^-$ is an anionic group.

8. The composition as claimed in claim 7, wherein said anionic group is halides or alkyl sulphates.

9. The composition as claimed in claim 7, wherein said anionic group is selected from the group consisting of chloride, methyl sulphate and ethyl sulphate.

* * * * *